US005109389A

United States Patent [19]

Stenzel

[11] Patent Number: 5,109,389

[45] Date of Patent: Apr. 28, 1992

[54] APPARATUS FOR GENERATING AN INDUCTIVE HEATING FIELD WHICH INTERACTS WITH METALLIC STOCK IN A CRUCIBLE

[76] Inventor: Otto Stenzel, Vonhaeuserstrasse 50, D6466 Gruendau 4, Fed. Rep. of Germany

[21] Appl. No.: 498,943

[22] Filed: Mar. 26, 1990

[30] Foreign Application Priority Data

Apr. 4, 1989 [DE] Fed. Rep. of Germany ..... 3910777

[51] Int. Cl.[5] ..... H05B 6/22

[52] U.S. Cl. ..... 373/156; 373/76; 373/138; 373/139; 373/154; 373/157; 373/158

[58] Field of Search ..... 373/156, 157, 158, 159, 373/160, 11, 72, 118, 163, 138, 139, 144, 146, 149, 150, 140, 155, 165, 149, 76; 219/6.5, 7.5, 10.491

[56] References Cited

U.S. PATENT DOCUMENTS

| | | | |
|---|---|---|---|
| 1,839,802 | 1/1932 | Northrup | 373/146 |
| 1,939,623 | 12/1933 | Clamer | 373/146 |
| 3,461,215 | 8/1969 | Reboux | 373/156 |
| 3,531,574 | 9/1970 | Sterling et al. | 373/156 |
| 3,544,691 | 12/1970 | Adamec | 373/146 |
| 3,775,091 | 11/1973 | Clites et al. | 373/155 |
| 4,058,668 | 11/1977 | Clites | 373/76 |
| 4,183,508 | 1/1980 | Michelet et al. | 373/156 |
| 4,238,637 | 12/1980 | Binger et al. | 373/146 |
| 4,583,230 | 4/1986 | Komada et al. | 373/156 |
| 4,660,212 | 4/1987 | Boer et al. | 373/156 |
| 4,873,698 | 10/1989 | Boer | 373/156 |
| 4,923,508 | 5/1990 | Diehm et al. | 373/163 |

FOREIGN PATENT DOCUMENTS

| | | | |
|---|---|---|---|
| 540992 | 5/1957 | Canada | 373/156 |
| 735897 | 5/1980 | U.S.S.R. | 373/165 |

*Primary Examiner*—Bruce A. Reynolds
*Assistant Examiner*—Tu Hoang

[57] ABSTRACT

An apparatus for melting metallic stock as a crucible in which the metallic stock is received and melted, the stock in the crucible having an axis along which the force of gravity varies, and an inductive heating system which generates an inductive heating field having an inductive power density which varies along the axis. The inductive heating field interacts with the metallic stock in the crucible so that the radiation energy generated by the inductive heating field counteracts the hydrostatic pressure of the melt in the crucible.

54 Claims, 6 Drawing Sheets

APPARATUS FOR GENERATING AN INDUCTIVE HEATING FIELD WHICH INTERACTS WITH METALLIC STOCK IN A CRUCIBLE

BACKGROUND OF THE INVENTION

The present invention relates to an induction melting furnace comprising a crucible having an inductor surrounding the crucible and containing a metal or metal alloy, with segments and slots in the crucible.

When melting substances in a crucible, care must be exercised to insure that the melting temperature of the crucible is higher than the melting temperature of the material to be melted. This difference in melting temperature must be maintained, since in traditional crucibles, the inside surface of the crucible has the same temperature as the melt. A ceramic crucible will usually meet this requirement since it has an extremely high melting temperature.

A ceramic crucible's highly heated inside surface, however, can chemically react with the melt. The crucible material will then contaminate the melt. The contamination usually takes the form of oxidation of the melt upon reduction of the crucible oxide ceramic. It is also possible for the crucible's impurities, for example sulphur, to enter into solution. In addition, flakes of ceramic particles can come off the crucible and fall into the molten material. After solidification of the molten material, the flakes can form inclusions. These inclusions are often referred to as "low density inclusions" and diminish the quality of the solidified melt since, for example, the inclusions are the starting points for cracks.

One possibility of avoiding these problems is to manufacture the crucible of metal instead of ceramic. With a metal crucible, however, a substance having a high melting temperature cannot be melted in the crucible. For example, if a copper crucible, without any special measures, were used to melt a metal such as tantalum, tungsten, or thorium, the copper crucible would melt long before the melting temperature of these metals was reached.

In order to melt substances with a high melting temperature in a crucible made of a metal with a lower melting temperature, it has long been known to cool the crucible with water. As a result, the crucible is continuously held at a temperature below its melting point The problem with this device, however, is in heating the material to be melted. Since the container holding the material is itself cooled, the container cannot permit any material to be melted to reach any higher temperatures.

The problem can be resolved in a simple way by electrically heating the material to be melted, namely by induction heating. A coil, supplying electrical energy to the material to be melted, through the crucible wall, is thereby provided around the crucible The metal crucible can then be composed of individual segments, separated from one another by an insulating layer so that the crucible is not excessively heated by eddy currents from the induction heating (see German Pat. No. 518 499). The insulation could be, for example, mica.

Another known induction melting furnace for melting metals comprises an oblong, electrically insulated, and water-cooled melting crucible that is open at the top and the bottom and has the same cross-section over its entire length (U.S. Pat. No. 3,775,091). This melting crucible is divided, by vertical slots, into at least two segments. Every segment is electrically insulated from the other segment so that no electrical shorts occur. The slots serve the purpose of reducing the shielding action of the crucible for the electric fields. The furnace has a ceramic lining in order to always produce and maintain insulation between the segments and at the inside of the crucible. The ceramic lining has electrical insulating properties in its solid state and a melting point temperature that differs from the melting point temperature of the metal to be melted. The ceramic insulating lining, for example, contains an alkaline earth metal fluoride. A self-generating insulating lining is produced as a result thereof.

A disadvantage of this furnace is that the employment of slag, when melting reactive metals, has the risk of contaminating the metal. It has also been shown that the quality of the molten material leaves a great deal to be desired, even given a partial pressure of argon or helium.

The employment of insulating slag between the melt and the cooled segments is not necessary for electrical reasons, as disclosed in German Patent 518 499. The insulating layers between the melt and the cooled segments are utilized since they represent a heat insulating layer and, thus, noticeably reduce the heat flux from the melt to the cooled segments. Therefore, the melting can be performed with a lower electrical induction heating capacity. The size of the power supply can then be lowered, and the current forces that limit the process are not yet that noticeable.

A known method for induction melting of reactive metals and alloys in a non-reactive environment comprises melting the material to be melted in a crucible subdivided into segments, without insulating slags (EP-A-0276544). This method is intended to produce qualitatively, high-grade products that have not been contaminated by slags or the like. Therefore, the wall segments of the crucible are not electrically insulated from one another but are connected to one another at their base and thus electrically shorted, as disclosed in the preceding publications and in German Patent 518 499. In addition, the crucible is provided in an evacuated space having less than 500 μm Hg. The disadvantage of this method is that the induction introduced electric heating capacity is the same over the entire height of the crucible and does not lead to an optimum melting time.

In diffusion blast furnaces, vacuum furnaces, and pottery kilns, the heating region in each is subdivided into various zones. A different coil can then be used for each zone (U.S. Pat. No. 3,291,969; German Published Application 21 52 489; U.S. Pat. No. 4,011,430; and German Pat. No. 27 04 661). These furnaces, however, are not suitable for melting materials which have a melting temperature which is higher than the melting temperature of the crucible.

A fundamental disadvantage of the above-described melting processes, which have a cooled crucible, is that the material to be melted suffers high losses of energy by emitting heat to the crucible wall. The thermic process efficiency can only be kept at an acceptable level by performing the melting process as quickly as possible. Therefore, the quantity of energy dissipated as heat loss, as a product of dissipate power and time, is small.

SUMMARY OF THE INVENTION

It is an object of the present invention to provide an induction melting furnace for treating metallic stock which does not contaminate the stock and which improves the process of melting the stock and maintaining the stock in a molten state.

The above object is achieved in accordance with the principles of the present invention in an induction melting furnace having a crucible with a substantially vertically oriented axis and means for inductively heating the metallic stock in the crucible by generating an inductive heating field having an inductive power density which varies topically relative to said crucible. Preferably the inductive power density is greater at a lower portion of the crucible than at an upper portion of the crucible.

The metallic stock may consist entirely of a single metal, or may be a metal alloy.

Preferably the inductive heating means is a coil system, preferably with a downward pitch. The coil system may be a single coil, with the variation in inductive power density being obtained by shielding the portion of the crucible which is to receive less inductive power, or by providing a higher winding density in the coil for the crucible portion which is to receive more inductive power. The coil system may consist of a single coil connected to a power supply, or two or more coils respectively associated with different portions of the crucible. If two or more coils are used, they can be all connected to a common power supply or can be connected to a common power supply or can be connected to respective, separate power supplies, The power supply (or supplies) may be an A.C. supply operating in a range of about 1.0 to 5.0 kHz, preferably 2.5 or 5.0 kHz.

The crucible is preferably formed by a plurality of conductive segments having vertically-running seams or spaces therebetween. The segments may be provided with conduits running in the interior of each segments in which a coolant is circulated so that, although the temperature of the melt in the crucible is maintained high, the temperature of the crucible itself (i.e., the segments) is relatively lower. The coolant which is used is preferably a molten metal such as Na or a Na and K mixture, or an organic liquid such as an oil having a high flashpoint, or a molten salt such as $NaNO_2$, $NaNO_3$, or $KNO_3$.

An advantage achieved with the invention is that the electrical energy can be efficiently brought to the material to be melted without this material being contaminated with electrically insulating parts, because the slots between the segments of the crucible are filled with an insulator only in a region which does not come into contact with the melt. This region is empty, at a side thereof facing the melt, to the depth of about one slot width. Moreover, the melting process can be uniformly and quickly implemented because the radiation pressure of the inductive energy supply counteracts the gravitational pressure of the melt. The maximum possible heating capacity is achieved due to the height-dependent power density at a selected operating frequency. Simultaneously, the heat losses from the melt to the crucible are reduced since the mechanical seating surface between the melt and the crucible is kept as small as possible. This occurs in the cylindrical part of the melt due to the outside surface of the melt being partially repelled by the height-dependently optimized electromagnetic radiation pressure. The cross-section of the crucible is thereby fully exploited at all levels of the molten bath. If the bath cone is stabilized with additional measures, the heat-radiating surface is kept as small as possible in this region.

The advantages of the invention are present not only during the melting process, but also during what is referred to as temperature maintenance, i.e. during the time in which the metallic stock has already been melted and is to be kept in its molten condition for a prescribed time span. During the temperature-maintaining time, the frequency of the heating induction current is lowered to such an extent that forces of a height similar to that during melting occur at reduced power. In order to avoid local over-heatings, particularly given large crucibles, different frequencies can be utilized in different heating zones, or different sub-coils can be used in another embodiment of the invention. The height-dependent power distribution also offers the advantage during temperature maintenance that the melt can quickly degassify due to the relatively large surface that is formed, so that the treatment time and the losses are reduced. Additionally, a large, interconnected eddy flow, which thermically and metallurgically mixes the melt well, forms in the melt region with a downwardly increasing power density. In addition to having advantages during melting and during temperature maintaining, the invention also has advantages during solidification of the melt. As is known, the inductive melting of materials in a cooled crucible has the general advantage over conventional induction melting that the melt need not be cast out into an ingot mold. To the contrary, it is possible to allow the melt to solidify in the crucible, thereby reducing capital costs. A block quality similar to that in gravity die-casting is thereby achieved by merely shutting the induction current off. Due to the structure of the invention which permits the lower heating zones to be operated to generate a lower inductive heating power output in comparison to the upper heating zones, the solidification zone proceeds slowly from bottom to top of the melt and a selected solidification structure can thus be obtained. It is advantageous for some alloy types to produce a fine-grained primary structure. The stirring effect of the electromagnetic field maintained in the liquidus region effects production of a fine grain structure in the block.

DETAILED DESCRIPTION OF THE PRESENTLY PREFERRED EMBODIMENTS

The present invention relates to an induction melting furnace that produces a high-purity metal by melting and reduces heat losses.

Figure 1A:
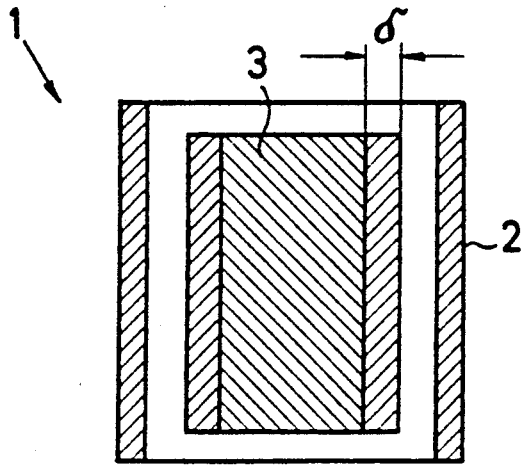
FIG. 1*a* illustrates a known induction melting furnace.

FIG. 1*a* illustrates a conventional induction melting furnace 1 comprising an inductor 2 and a meltable stock 3. The inductor 2 is composed of a coil that has an inductance and an ohmic resistance. A current flows through the inductor 2, inducing a voltage in the melting stock 3. The melting stock 3 is composed of conductive material. The voltage in the melting stock 3 causes a current conduction in the melting stock 3 that results in a heating of the melting stock 3. The penetration depth of the current is referenced as $\delta$.

Figure 1B:
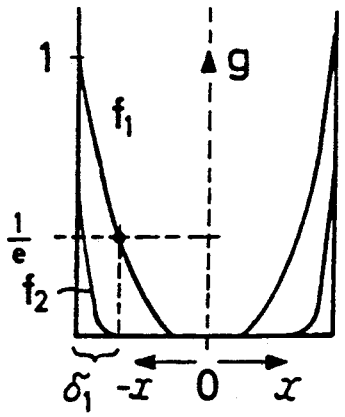
FIG. 1*b* illustrates a graph of the known dependency of the penetration depth into a metallic block.

FIG. 1*b* illustrates the curve for the current density g dependent on the distance from the center, $x=0$, for two different frequencies, with $f_2>f_1$. The penetration depth for the frequency $f_1$ is referenced $\delta_1$; what is thereby involved is that the location given a planar extremely thick wall at which the current density g has decreased from 1 to 1/e, whereby e is Euler's number. The figure illustrates that the current penetrates less and less deeply the higher its frequency.

Currents which flow in the melting stock 3 are also referred to as eddy currents. Eddy currents always occur when electrically conductive materials are located in an alternating magnetic field. Eddy currents flow in paths that are linked to the magnetic induction lines. The creation and properties of eddy currents are known (see K. Kupfmueller, Einfuehrung in die Theoretische Elektrotechnik, 1984, page 304ff).

This specific thermal output, i.e., the power converted into heat in a volume unit of the meltable stock 3, also has an important role in induction melting furnaces. Distribution of this thermal output is also known (see K. Simonyi, Theoretische Elektrotechnik, 1956, page 304).

Figure 2A:
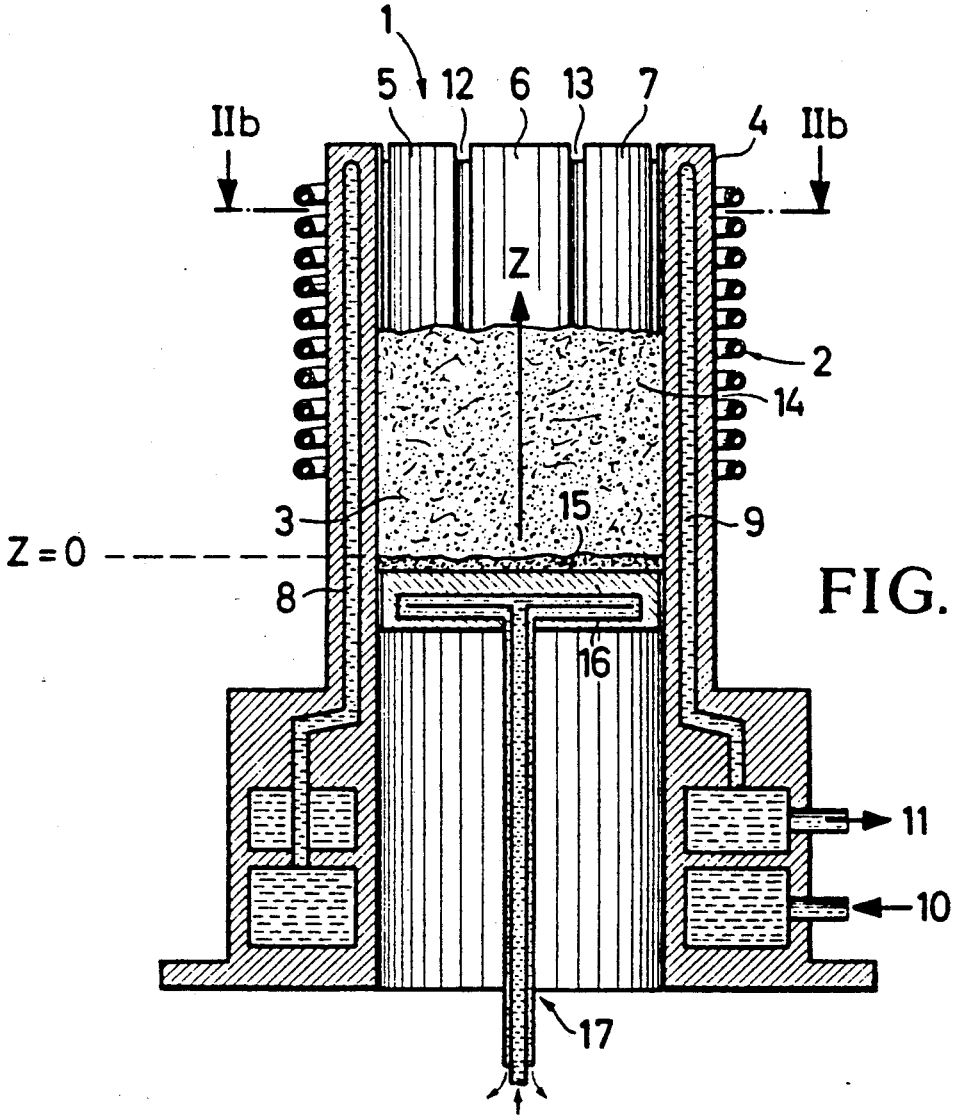
FIG. 2*a* illustrates a water-cooled induction melting furnace of the present invention.
Figure 2B:
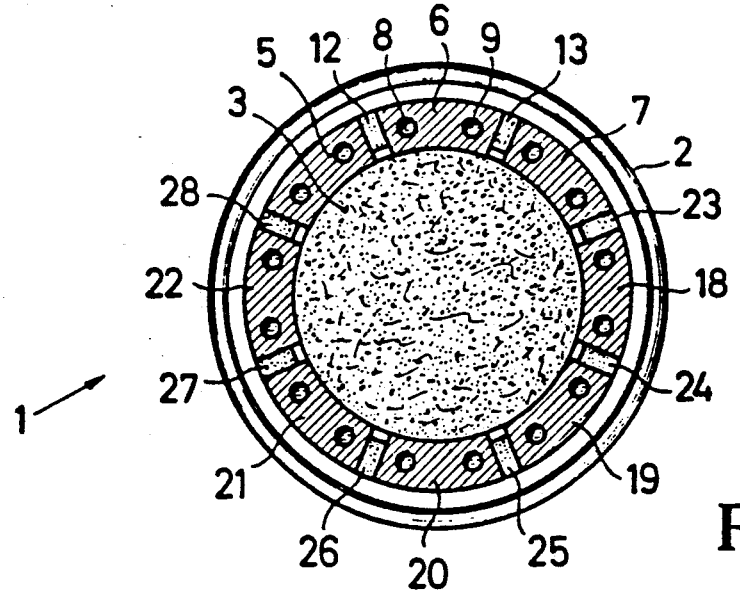
FIG. 2*b* illustrates a top view of the melting crucible of the furnace of FIG. 2*a*.

FIG. 2*a* illustrates an induction melting furnace 1 comprising a crucible 4 which is divided into segments 5, 6, 7. An inductor 2, i.e., a coil, is located on the crucible 4. The coil 2 generates an inductive heating field which interacts with the meltable stock 3, which in the structure described herein is metallic stock. The term "metallic" as used herein to describe the meltable stock 3 means that the stock 3 may consist entirely of one metal (with impurities at a level consistent with the desired purity of the final product) or the stock 3 may be a metal alloy. Cooling tubes 8, 9, having a water intake opening 10 and a water discharge opening 11, are located in the individual segments 5, 6, 7 of the crucible 4.

The crucible 4 has an axis along which the hydrostatic pressure measured along an axis parallel to the direction of the force of gravity acting on the metallic stock varies (the Z direction shown in FIG. 2*a*). FIG. 2*a* illustrates a coil 2 having a magnetic field that varies in the Z direction. The magnetic field normally has a maximum value in the center of the coil 2. The crucible creates a shielding effect with respect to the magnetic field that is smaller at the top of the crucible than in other areas. The magnetic field, in combination with the gravitional field, creates an undesired distribution of force, i.e., great forces at the top and smaller forces at the bottom of the crucible. The inductive power density is preferably higher at a bottom portion of the crucible 4. This can be accomplished, as schematically shown in FIG. 2*a*, by including a magnetic shield 2*a* surrounding, as part of the inductive heating means, the upper portion of the crucible 4. In other embodiments discussed below, this is accomplished by varying the winding density of the coil 2.

The crucible 4 consists of material which does not chemically interact with the metallic stock under normal operating conditions.

In a preferred embodiment, the crucible 4 is composed of a metal having relatively good thermal conductivity. Metal is preferred over glass or ceramic since glass or ceramic can excessively contaminate the metal to be melted. Since metals with good thermal conductivity are also good electrical conductors, the magnetic energy generated by the coil 2 mainly advances through the slots 12, 13, which are located between the segments 5, 6, 7 of the crucible 4, to the melting stock 3. The melting stock 3 is molten in its upper region 14. The melting stock 3 is supported by a solidified layer 15 on a cooled plate 16. The cooled plate 16 can be moved up or down with a rod 17.

The molten, meltable stock 3 can be considered a liquid with respect to its mechanical properties. Assuming that the molten, meltable stock 3 is at rest, i.e., keeping flows of the molten, meltable stock 3 out of consideration, then the pressure acting on a point in the molten, meltable stock 3 is not dependent on the orientation of the surface element on which it acts. The pressure in the resting liquid is assumed to be the same in all directions. Following therefrom, the same pressure prevails at points of identical height in a liquid column. Pressure, however, does vary dependent on the height coordinate within the molten stock 3. If $z_0$ is assumed as a fixed level and the coordinate system is selected so that $z_0=0$, then the following is valid for pressure p(z):

$$p(z)=p_0-\rho gz$$

wherein $\rho$ is the density of the melt and g is the acceleration due to gravity. This equation, from hydrostatics, states that the pressure linearly decreases with increasing height, or linearly increases with depth in a heavy, constant-density liquid.

The electromagnetic energy that the coil 2 supplies to the meltable stock 3 principally penetrates through the slots 12, 13 and produces a radiation pressure in the volume of the melt. When the local radiation pressure exceeds the liquid pressure exerted on the walls of the crucible, the molten, meltable stock 3, at the slots, 12, 13, is displaced inward It is displaced inward to such an extent that a state of equilibrium derives from the displaced material due to the field strength attenuation and/or an increase in liquid height. Consequently, an optimum heat melting process is not possible. The radiation pressure at the inside wall of crucible 4 then should not be higher than the hydrostatic pressure of the molten, meltable stock 3. Since the hydrostatic pressure is dependent on the z-coordinate, the radiation pressure in the present invention has been designed so that it is also dependent on the z-coordinate. For example, this is done in such a fashion so that a square of the amplitude of the magnetic field penetrating into the meltable stock 3 linearly increases from top to bottom.

The chronologically averaged radiation pressure of an electromagnetic wave perpendicularly incident on a conductive metal, from which the wave is partially reflected, is:

$$p=\frac{1}{T}\int\int_0^\infty \epsilon\vec{E}(x_1t)\times\mu H(x_1t)dxdt$$

wherein $\epsilon$ is the dielectric constant, $\mu$ is the magnetic permeability, $\vec{E}$ is the electrical field strength of the wave, and $\vec{H}$ is the magnetic field strength of the wave (see Bergmann/Schaefer, Lehrbuch der Experimentalphysik, Vol. 2, Elektrizitaet und Magnetismus, 7th Edition, page 501; mathematical deviations of the radiation pressure by Maxwell's voltage tensor may be found in, for example, W. Greiner, Theoretische Physik, Vol. 3, Klassische Elektrodynamik, 4th Edition, 1986, pages 242–247).

When the wall has a finite conductivity, as in the meltable stock 3, the incident wave is only partially reflected so that the electric field strength does not entirely disappear at the wall. In that case, the electric field strength also contributes to the pressure. The magnetic field strength is correspondingly lower than before. When the wave also partially penetrates through the wall, a pressure also appears at the back side and is to be subtracted from the pressure acting on the front side.

The power density or radiated power per surface unit is referred to as the Poynting vector (see Simonyi, page 28ff). The Poynting vector is defined as the vector product of the electric field strength and the magnetic field strength:

$$\vec{S}=\vec{E}\times\vec{H}.$$

Relatively simple mathematical expressions derive for the planar arrangement. Although the crucible in the present invention is not a dynamically balanced member, the differences, when compared to a planar arrangement, are not especially great in practice. For that reason, it is adequate to erect the essential equation for planar conditions and to waive the cylindrical functions that are more difficult to survey. The following boundary conditions arise when based on a planar arrangement:

| | |
|---|---|
| $E_x = 0,$ | Whereby $E_x$ is the component of electric field strength in the x-direction. |
| $E_y = E_o \cdot e^{\delta^{-\frac{x}{}}} \cdot e^{\delta^{-j\frac{x}{}}},$ | Whereby $E_y$ is a component of electric field strength in the y-direction, $\delta$ is the penetration depth, and $E_o$ is the maximum amplitude of the electric field strength. |
| $E_z = 0,$ | Whereby $E_z$ is the component of the electric field strength in the z-direction. |
| $H_x = 0,$ | Whereby $H_x$ is the component of the magnetic field strength in the x-direction. |
| $H_y = 0,$ | Whereby $H_y$ is the component of the magnetic field strength in the y-direction. |
| $H_z = E_{o\frac{\epsilon\cdot\delta}{1+j}} \cdot e^{\delta^{-\frac{x}{}}} \cdot e^{\delta^{-j\frac{x}{}}},$ | Whereby $E_o$ is a maximum amplitude of the electric field strength, $\epsilon$ is the dielectric constant, and $j=\sqrt{-1}$. |

According to the rules of complex computation, $$S_x=\tfrac{1}{2}R_e(E_y H_z^*)$$

is the magnitude of the Poynting vector in the x-direction. $H_z^*$ is the conjugate of $H_z$. The numerical factor $\frac{1}{2}$ derives from the chronological averaging in the sinusiodally changing events (see Simonyi, page 283, equation 35).

After a conversion, the input power density going at the surface derives at:

$$S_o = E_o^2 \cdot \frac{\epsilon \cdot \delta}{4}$$

(see Simonyi, page 283, equation 38).

The electromagnetic power acting on molten, meltable stock 3 generates mechanical forces in the melt. The volume force density $\vec{f}$, for the case of an electric conductivity and permeability constant over the volume, is described:

$$\vec{f}=\vec{J}\times\vec{B}=\epsilon\cdot\mu\cdot\vec{E}\times\vec{H}$$

where $\vec{J}$ is the current density and $\vec{B}$ is the magnetic induction.

The volume force density is directly proportional to the magnitude of the Poynting vector. The quantity of "pressure" forming in the melt's volume is calculated by integrating the scalar product of the volume force density and the distance:

$$p = \int_0^x \vec{f}\cdot\vec{ds}.$$

Since only one volume force density component is normally perpendicularly incident, relative to the surface of the planar field, the following applies:

$$\begin{aligned} p &= \int_0^x f_x \cdot dx \\ &= 1\epsilon \cdot \mu R_e \int_0^x E_o \cdot e^{\delta-\frac{x}{}} \cdot e^{\delta-j\frac{x}{}},\ E_o\frac{\epsilon\cdot\delta}{1-j} \cdot e^{\delta-\frac{x}{}} \cdot e^{\delta-j\frac{x}{}} \\ &= \frac{1}{8}\mu\epsilon^2 \cdot \delta^2 \cdot E_o^2[1 - e^{\frac{2x}{\delta}}] \end{aligned}$$

From the result of the power density of the surfaces inserted into this equation, the following derives:

$$p = \frac{1}{2\pi f\delta} \cdot S_o[1 - e^{\frac{-2x}{\delta}}]$$

Thus, the electromagnetic radiation pressure does not suddenly appear at the surface of the material, but rather, increases over the distance that is normally relative to the surface. Since the penetration depths are small at the standard heating frequencies, it can be assumed that the electromagnetic pressure acts on the surface of the molten bath in a first approximation for the formation of the surface of the molten bath. Thus, the electromagnetic radiation pressure is proportional to the power density present in the melt.

FIG. **2*b* illustrates a top view of the melting furnace 1 of FIG. 2*a*. The figure illustrates segments 5, 6, 7 with slots 12, 13 between the segments, as well as segments 18–22 with slots 23–28** between them.

In the present invention, the melting process begins in the middle of the individual segments 5, 6, 7 and 18–22 and not behind the slots 12, 13, 23–28. When the meltable stock 3 is in a molten condition, it is displaced inward, and a radially inward flow, which is most pronounced at the bath surface, forms in the melt. The ridges, projecting from the melt, reside star-shaped in an outward direction and are situated opposite the centers of the individual segments 5, 6, 7, 18–22. A field incidence over the upper edge of the crucible from above onto the molten bath cone must be avoided, or a tent-like deformation of the bath cone will arise and will promote the formation of folds. For example, the field incidence over the crucible edge can be prevented by not having the coil 2 extend beyond the crucible edge.

Figure 3:
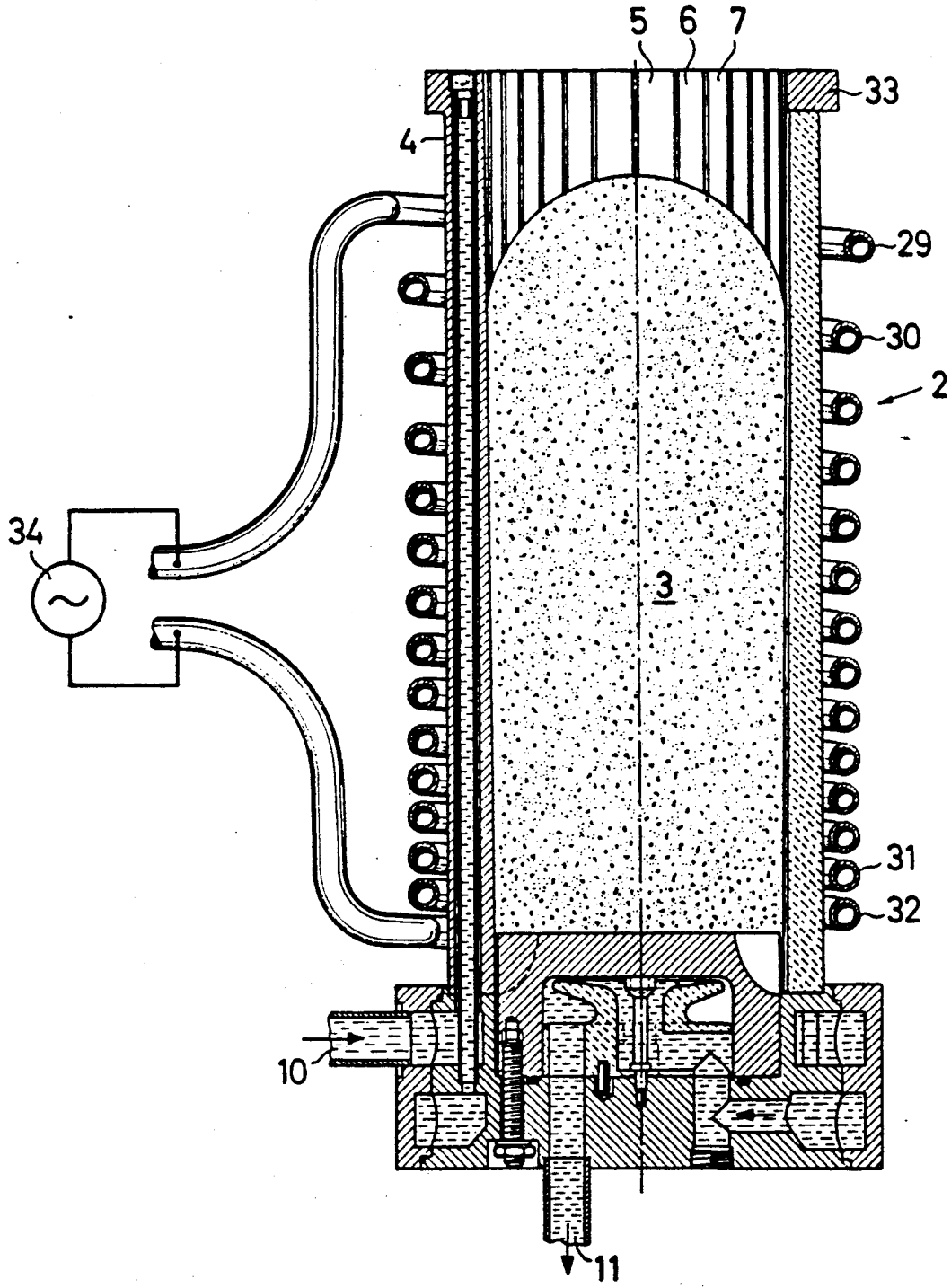
FIG. 3 illustrates an embodiment of the induction melting furnace of the present invention.

FIG. 3 illustrates an embodiment of the present invention, which has a differently arranged cooling system, comprising a coil having a downwardly decreasing pitch. The crucible 4 still has a plurality of segments 5, 6, 7, a volume, for example, of 5.5 $dm^3$. It also still has a coolant intake opening 10 and a discharge opening 11 for cooling water in the segments 5, 6, 7. Other possible coolants are a molten metal, for example, Na or NaK, an organic liquid, for example a silicon oil having a high flashpoint, or a molten eutectic salt, for example, $NaNO_2$, $NaNO_3$,$KNO_3$ or mixtures thereof. The upper turns 29, 30 of the coil 2 lie farther apart from one another than the lower turns 31, 32 are from one another. As a result, a larger winding density that exerts a higher pressure on the melting stock 3 is present in the lower region of the coil 2.

A shorting strap or ring 33 is located at the upper edge of the crucible 4 and causes a certain linearzation of the magnetic field. A linearzation is required since the coil 2 ends abruptly at its upper edge which causes an abrupt change in the magnetic field strength, but the distant field decays slowly. The field strength over the crucible edge is greatly reduced with the shorting strap or ring 33, so that a field attenuation results in the region of the melt surface and thus a limitation on the bath camber occurs. The shorting strap 33 lies on and is connected to the segments 5, 6.

The coil 2 is connected to a power supply 34. The power supply 34 is an AC power source having a frequency of approximately 1,000 to about 5,000 Hz. The current flowing through the upper turns 29, 30 and lower turns 31, 32 of the coil 2 is the same at all locations.

The molten, meltable stock 3 flows in the crucible 4 in the induction melting system of the present invention. In the lower through middle coil region, the molten, meltable stock 3 flows inward. At that point, it is upwardly and downwardly deflected and again flows downward against the outside of the melt; the inwardly directed forces are the greatest there. The material flowing upward in the region of the center of the melt is visible at the surface of the molten bath. It can cause instabilities in the bath cone. A passive flow, that is produced by the friction forces of the main flow of the cone, derives in the melt ridges which are formed because of the radiation pressure.

In a practical embodiment of the present invention, the power supply delivers a voltage having a frequency of 2,500 or 5,000 Hz. By the known equation:

$$\delta = \frac{1}{\sqrt{\pi f \mu \epsilon}},$$

the penetration dimensions are 4.8 mm and 3.4 mm when aluminum is the molten liquid. When titanium is the molten liquid, the penetration dimensions are 13.3 mm and 9.4 mm. The frequency boost leads to a diminution of the penetration dimension.

Figure 4:
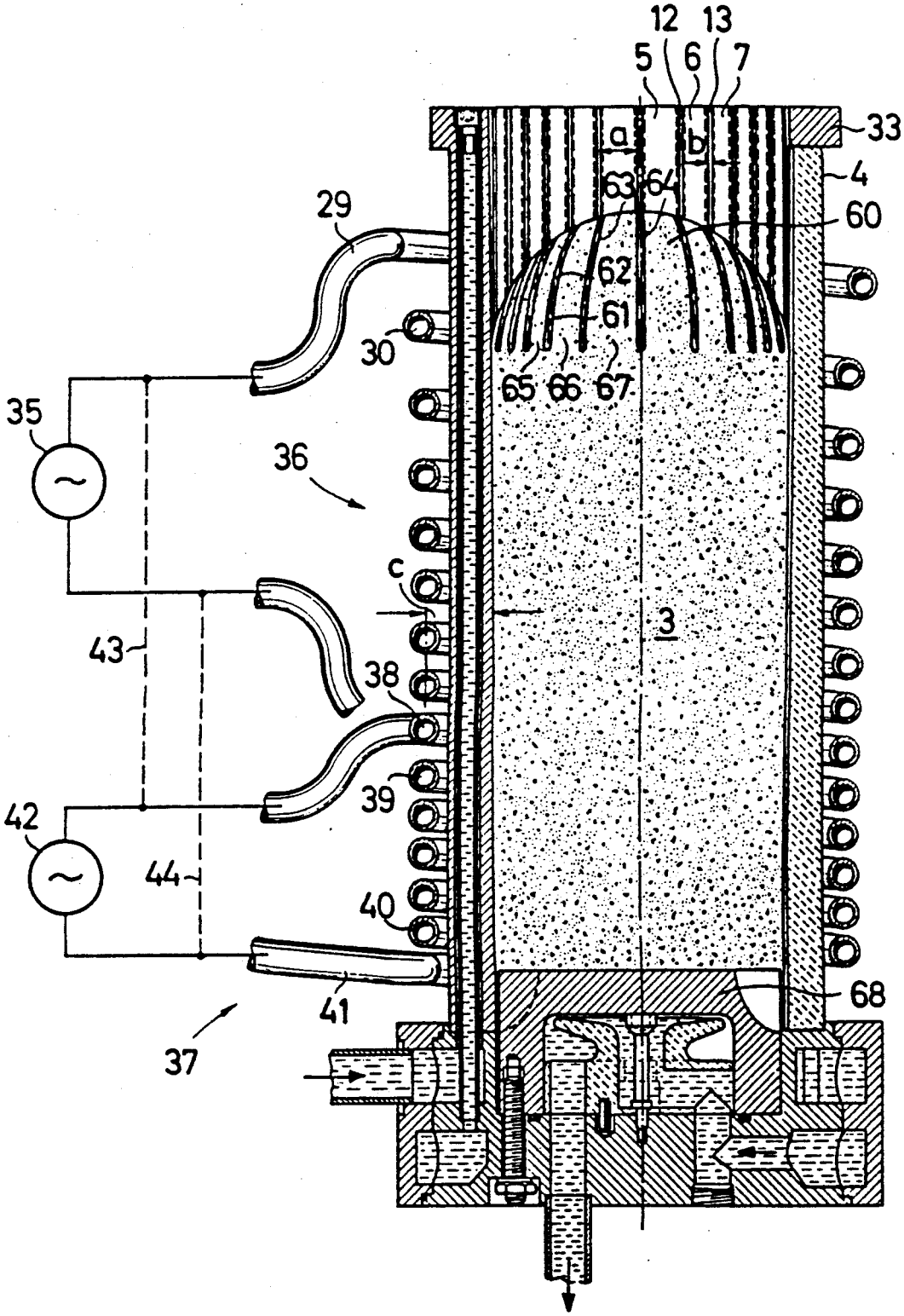
FIG. 4 illustrates another embodiment of the induction melting furnace of the present invention.

FIG. 4 illustrates another embodiment of the present invention wherein the current intensities of the coil windings are not the same at all locations. The first sub-coil 36, having windings 29, 30 is in the upper region of the crucible 4. These windings are connected to a first power supply 35. The number of turns of the first sub-coil 36 is relatively high. A second sub-coil 37, having windings 38–41, is located in the lower region of the crucible 4. The second sub-coil 37 is shorter and has a lower number of turns than the first sub-coil 36. The second sub-coil 37 can be connected to its own power supply, such as a second power supply 42.

It is also possible to connect the first sub-coil 36 to the second sub-coil 37 and use a single common power supply 35 or 42, in parallel, as indicated by the broken lines 43, 44 in the figure. If the sub-coils 36, 37 are connected in parallel, the lower region of the crucible 4 will exhibit a higher radiation pressure than the upper region of the crucible 4 because of the higher coil currents and the higher winding density of the lower sub-coil 37. If the first and second power supplies 35, 42 are employed separately for the sub-coils 36, 37, the currents flowing into the sub-coils 36, 37 can be selected so that the currents produce the required radiation pressure.

The cone of the molten bath is referenced 60 in FIG. 4. This cone should be cambered as little as possible and should not be furrowed by the radiation pressure. As previously discussed, the measure of reducing the field strength can be selected to counter the camber. The furrowings or channels 61–64 of the cone 60 are essentially caused by the penetration of the electromagnetic radiation through slots 12, 13 between segments 5, 6, 7.

The ratio of the segment width "a" to the slot width "b" is critical for the properties of the bath cone 60. In order to optimally define this ratio, a number of aspects are to be taken into consideration. First, the number of segments should be optimized so that the electromagnetic field can penetrate the melting stock 3 through many different slots. It is also desirable that the number of these segments not be excessively large so that the lengths of the current path, in which the eddy currents can be induced, do not become excessively large.

The circumference of the crucible 4, divided by the number of segments 5, 6, 7, should yield the segment width "a", that is comparable to or even smaller than the penetration depth $\delta$ of the field into the melting stock 3. The segment width "a" defines the periodicity of the field in a circumferential direction. Therefore, for a small segment width "a", the bulges or lamellae 65, 66, 67 at the bath cone 60 have such a great curvature at their peak and at their floor, that the surface forces for dismantling the bulges 65, 66, 67 are intensified. To prevent the formation of bulges or lamellae 65, 66, 67 at the bath cone 60, the field strength can be reduced in the cone region. Alternately, the frequency of the field can be increased. Narrow segments 5, 6, 7 can also be used.

Losses in the metallic segments 5, 6, 7 arise because the magnetic field must penetrate radially inward. These losses are caused by induction currents which produce undesirable thermal losses. These losses can be limited by making the slots 12, 13, between the segments 5, 6, 7, optimally wide. Since the slot width "b" should be optimally small at the side directed toward the melting stock 3 so that no melt can penetrate outward, expanding the slot radially outward offers a compromise.

Thereby, the losses, due to the mutual current displacement, are reduced as a result of the greater distance between the segments 5, 6, 7.

The same design principles that fundamentally apply to the inductor windings, apply to the cross section of the segments 5, 6, 7, so that no sharp edges should be present as far as possible since large thermal losses appear at such sharp edges. The radius, at the edges, should be greater than 1.5δ to about 2δ. The width "b" of the slots 12, 13 between the segments 5, 6, 7 can be changed in a vertical direction or, respectively, in an axial direction. In a particularly advantageous embodiment, it is advantageous when the slots, between the segments, widen below the molten, meltable stock 3, i.e. at the floor 68.

The electric voltages prevailing between two segments 5, 6, 7 are not dependent on the width b of a slot 12, 13. Rather, the voltage is derived from dividing the circumferential voltage by the number of segments 5, 6, 7. The segments 5, 6, 7 are bent toward the melt by the field of the induction sub-coils 36, 37. An inwardly directed deformation of the segments 5, 6, 7 also derives because of the heating at the melt side. This is referred to as the furnace box effect. Segments 5, 6, 7 can be supported to resist these forces, for example, with insulator elements between the segments 5, 6, 7. The insulator elements also prevent the run-out of the melt if a power outage occurs. The insulator should be offset, one to two column widths, toward the inside. The floor 68 of the crucible 4 is preferably a radially slotted, water-cooled block. It is insulated from segments 5, 6, 7 in its upper region. Moreover, its height is adjustable, so that it can be optimally adapted to the melt height.

In the apparatus of FIG. 4, which has a plurality of sub-coils 36, 37 above one another, it is possible to reduce the power, beginning with the lower sub-coil 37 until the melting stock 3 solidifies from below. This can be done until finally, only the upper most sub-coil 36 is operating with reduced power, so that the melt 3 is still kept molten, for a while, in the immediate proximity of the surface of the molten bath. Formation of sinkholes in the block head is also avoided by maintaining this liquidity which is also referred to as "hot topping". The lower sub-coil 37 can also be operated at a lower frequency than the upper sub-coil 36.

Figure 5:
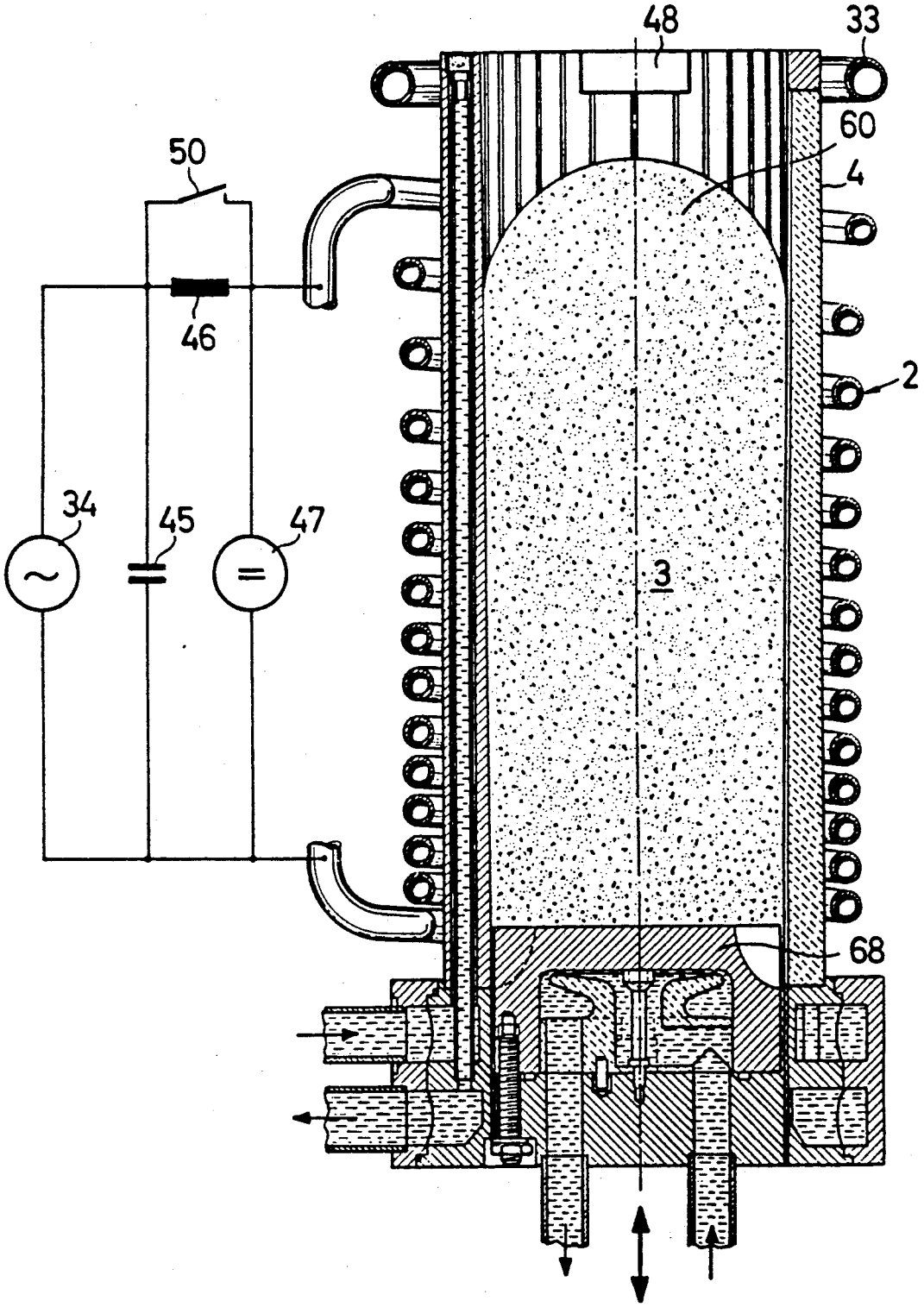
FIG. 5 illustrates a further embodiment of the induction melting furnace of the present invention.

FIG. 5 illustrates a further embodiment of the present invention wherein only one coil is supplied with electrical energy via the AC power source 34. A capacitor 45 is connected in parallel to the coil 2, so that the coil 2 forms a resonant circuit with the capacitor 45. An inductance 46, that causes a frequency modification and that can be shorted by a switch 50, is connected in the series with this parallel resonant circuit 2, 45. A DC power source 47 is also connected parallel to the AC power supply. 34 and to the parallel resonant circuit 2, 45. The DC power source 47 superimposes a direct current on the alternating current in the coil 2. The DC power source 47 generates a static magnetic field which calms the melt flow and stabilizes the shaping of the bath cone 60. In this case, the static magnetic field has the same direction as the alternating field. It is also possible to apply the static magnetic field perpendicularly relative to the alternating field and, in particular to apply it in the upper region of the melt. A sequence of static magnetic fields along the vertical axis of the crucible 4 can be generated, with successive fields in the sequence being of different polarities. The static magnetic field or fields can be produced by a separate winding (or windings) or by a permanent magnet (or magnets).

An additional heating source 48, that is only schematically illustrated in FIG. 5, is situated over the melting stock 3. This can thereby be an electron gun, a plasma source, an externally supplied resistance heater or the like.

If, for example, a plasma burner or a glow discharge anode is utilized as the energy source 48, a reactive gas can be introduced into the space between the surface 60 of the molten bath and heating source 48. Therefore, nitrites, oxides, or undesirable compounds of these substances, that float in the melt as inclusions, can be chemically destroyed.

During the melting of a solid charge, the floor 68 is displaced so that the cone 60 of the molten bath is held at approximately the same location, relative to the crucible 4 or, respectively, to the coil 2.

The division of electromagnetic power that is set can be respectively different for the different process stages, such as "melting", "maintaining temperature" and "blocks of solidification".

Figure 6:
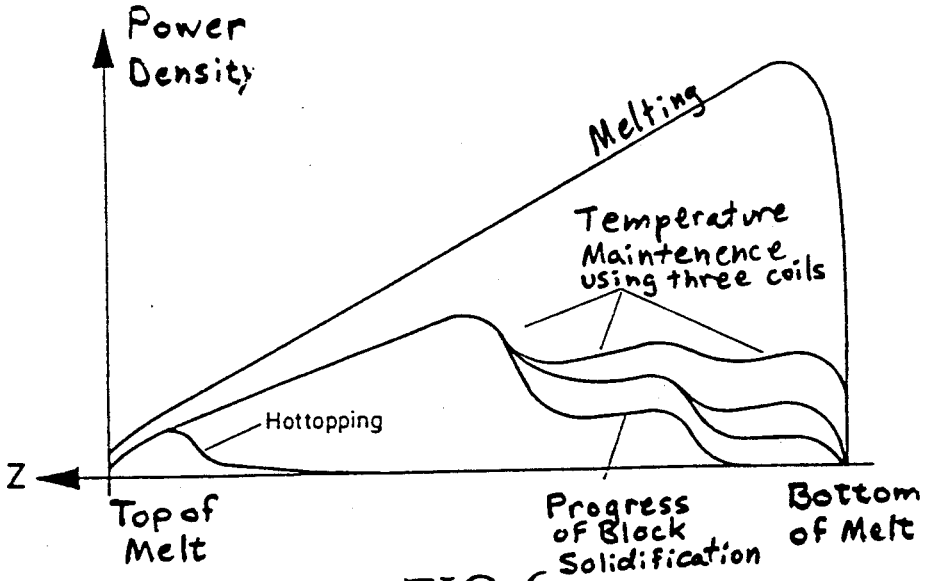
FIG. 6 illustrates a graph of the power density distributions over the Z-axis.

FIG. 6 illustrates graphically how the power density distribution may appear for an arrangement having a plurality of sub-coils.

Figure 7:
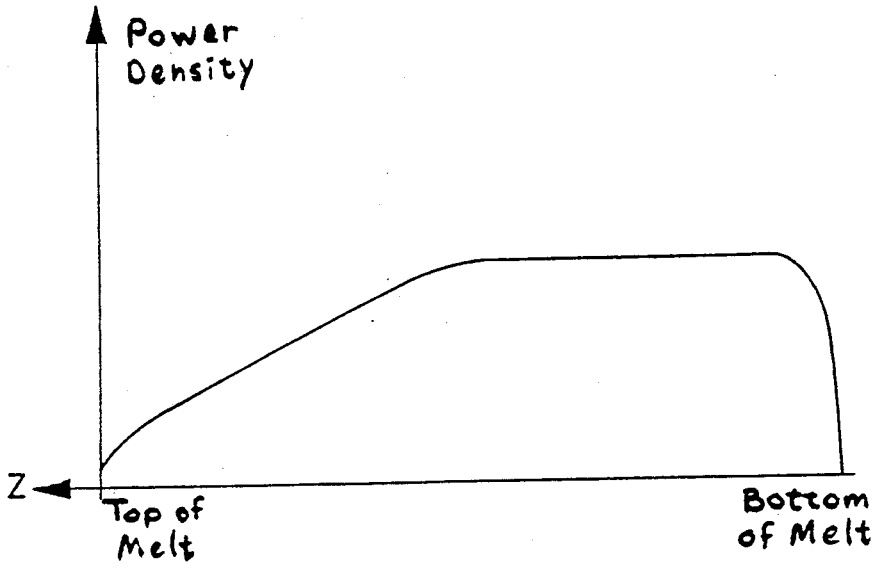
FIG. 7 illustrates a graph of the power density distributions over the Z-axis.

The crucible 4 should have a very thin design in order to achieve a high efficiency. For extremely tall crucibles, however, a power distribution as illustrated in FIG. 7 should be produced in order to limit the thermal stress on the coils and segments. As already mentioned, the crucible 4 has, for example, a volume of 5.5 $dm^3$. In general, the crucible can have a volume of 100 through 1000 $dm^3$.

The crucible 4 can be charged with a bundle of metallic stock 3 formed by a plurality of metallic stock elements held together with wire or strapping consisting of the same metal or metal alloy as the stock. The bundle preferably has a cross-sectional size (such as a diameter) which is between about 2% to 10% smaller than the diameter of the crucible 4.

Various changes and modifications to the embodiments described herein will be apparent to those skilled in the art. Such changes and modifications can be made without departing from the spirit and scope of the present invention and without diminishing its attendant advantages. It is therefore intended that such changes and modifications be covered by the appended claims.

I claim as my invention:

1. An inductive furnace comprising the following:

a crucible adapted to receive and hold molten metallic stock at a predetermined temperature and within a predetermined range of hydrostatic pressures, said crucible including an outer wall that is vertically segmented adjacent an area where said metallic stock is to be held;

means for cooling said outer wall to a temperature below said predetermined temperature; and inductive coil means surrounding said crucible in a predetermined configuration for generating an inductive heating field having an inductive power density that varies dependent upon said hydrostatic pressures of said metallic stock.

2. An inductive furnace as claimed in claim 1 wherein said crucible has a bottom and wherein said metallic stock in said crucible, when melted, exhibits a melt cone having a tip, and wherein said inductive coil means is a means for generating an inductive heating field having an inductive power density which varies linearly from said bottom of said crucible to said tip of said melt cone.

3. An inductive furnace as claimed in claim 1 wherein said crucible has a bottom, and wherein said inductive coil is a means for generating an inductive heating field having an inductive power density which varies linearly from bottom of said crucible to a selected height above of said crucible and is thereafter constant.

4. An furnace as claimed in claim 1 wherein said vertically segmented section of said crucible includes of a plurality of electrically conductive segments with spaces and wherein said metallic stock, when melted, exhibits melt cone, and wherein said inductive coil means is a means for generating an inductive heating field so the molten metallic stock is spaced away from said at said spaces except in an immediate region said melt cone, and said molten metallic stock presses said crucible in central regions of the respective segments.

5. An inductive furnace as claimed in claim 1 wherein said for cooling includes means for circulating a through channels in said crucible outer wall.

6. An inductive furnace as claimed in claim 5 wherein said means for circulating is a means for circulating water.

7. An inductive furnace as claimed in claim 5 wherein said means for circulating is a means for circulating molten metal.

8. An inductive furnace as claimed in claim 7 wherein said means for circulating is a means for circulating molten metal selected from the group consisting of Na and a mixture of Na and K.

9. An inductive furnace as claimed in claim 5 wherein said means for circulating is a means for circulating an organic liquid.

10. An inductive furnace as claimed in claim 9 wherein said means for circulating is a means for circulating a silicon oil having a high flashpoint.

11. An inductive furnace as claimed in claim 5 wherein said means for circulating is a means for circulating a molten eutectic salt.

12. An inductive furnace as claimed in claim 11 wherein said means for circulating is a means for circulating a molten eutectic salt selected from the group consisting of $NaNo_2$, $NaNO_3$, $KNO_3$ and mixtures thereof.

13. An inductive furnace as claimed in claim 1 wherein said inductive coil means is an induction coil assembly surrounding said crucible and adapted for connection to an AC power supply.

14. An inductive furnace as claimed in claim 13 wherein said coil assembly has a pitch defining ampere-turns per centimeter that vary between a bottom of said crucible and a top of said crucible, said pitch being lowest at said bottom of said crucible and highest at said top of said crucible.

15. An inductive furnace as claimed in claim 13 wherein said coil assembly has a higher winding density at a lower portion of said crucible than at a higher portion of said crucible.

16. An inductive furnace as claimed in claim 13 wherein said coil assembly includes a single coil surrounding said crucible.

17. An inductive furnace as claimed in claim 13 wherein said coil assembly consists of a plurality of coils disposed in sequence from top to bottom of said crucible, and means for supplying each of said coils with respectively different currents.

18. An inductive furnace as claimed in claim 17 wherein a coil at a bottom of said crucible is shorter than a coil at a top of said crucible.

19. An inductive furnace as claimed in claim 17 wherein a coil at a bottom of said crucible has fewer turns than a coil at a top of said crucible.

20. An inductive furnace as claimed in claim 17 wherein a coil at a bottom of said crucible is supplied with a higher current than a coil at a top of said crucible.

21. An inductive furnace as claimed in claim 17 further comprising separate power supplies respectively connected to each of said coils.

22. An inductive furnace as claimed in claim 17 further comprising a common power supply to which all of said coils are connected in parallel, and wherein each of said coils has a different number of terms.

23. An inductive furnace as claimed in claim 17 further comprising:

means for superimposing a static magnetic field on said inductive heating field.

24. An inductive furnace as claimed in claim 23 wherein said crucible has a substantially vertical axis, and wherein said means for superimposing a static magnetic field is a means for superimposing a static magnetic field coaxially with said crucible axis.

25. An inductive furnace as claimed in claim 23 wherein said crucible has a substantially vertical axis, and wherein said means for superimposing a static magnetic field is a means for superimposing a static magnetic field perpendicular to said crucible axis.

26. An inductive furnace as claimed in claim 23 wherein said molten metallic stock, in said crucible, exhibits a cone, and wherein said means for superimposing a static magnetic field is a means for superimposing a static magnetic field interacting substantially only with said cone of said metallic stock.

27. An inductive furnace as claimed in claim 23 wherein said crucible has a substantially vertical axis, and wherein said means for superimposing a static magnetic field is a means for superimposing a static magnetic field having a plurality of polarity reversals along said crucible axis.

28. An inductive furnace as claimed in claim 27 wherein said means for superimposing a plurality of static magnetic fields is a plurality of coils surrounding said crucible in sequence from top to bottom of said crucible, said coils having respective currents therein which alternate in the direction from coil to coil.

29. An inductive furnace as claimed in claim 23 wherein said means for superimposing a plurality of static magnetic fields is a plurality of permanent magnets disposed in sequence from top to bottom of said crucible, said permanent magnets alternating in a plurality from magnetic to magnetic.

30. An inductive furnace as claimed in claim 23 wherein said means for superimposing a static magnetic field is a coil, separate from said inductive heating means, connected to a DC power supply.

31. An inductive furnace as claimed in claim 23 wherein said inductive heating means includes a coil surrounding said crucible connected to an AC power supply, and wherein said means for superimposing a static magnetic field is a DC power supply connected to said coil.

32. An inductive furnace as claimed in claim 1 wherein said molten metallic stock has a top surface, and further comprising energy source means separate from said inductive coil means for heating said surface of said metallic stock.

33. An inductive furnace as claimed in claim 32 wherein said energy source means is a means for generating energy at a variable frequency.

34. An inductive furnace as claimed in claim 1 wherein said metallic stock, when melted, has an upper surface in said crucible, said inductive furnace further comprising:

an electrode disposed above said surface of said metallic stock;

means for introducing a reactive gas between said surface of said metallic stock and said electrode; and means for applying a voltage between said electrode and said surface of said metallic stock for bringing said reactive gas to a glow discharge.

35. An inductive furnace as claimed in claim 1 further comprising:

a load resonant means, connected to said inductive coil means, for lowering the resonant frequency of said inductive heating means.

36. An inductive furnace as claimed in claim 35 wherein said load resonant means is a capacitive load connected in parallel with said inductive coil means.

37. An inductive furnace as claimed in claim 35 wherein said load resonant means is an inductive load connected in series with said inductive coil means.

38. An inductive furnace as claimed in claim 1 wherein said segmented section of said crucible consists of a plurality of segments with vertical spaces therebetween.

39. An inductive furnace as claimed in claim 38 further comprising:

a short circuit ring disposed at a top of, and surrounding, said crucible, said short circuit ring being an electrical contact with each of said segments.

40. An inductive furnace as claimed in claim 1 wherein said crucible has a volume of 5.5 $dm^3$.

41. An inductive furnace as claimed in claim 1 wherein said crucible has a volume in a range from about 100 through 1000 $dm^3$.

42. An inductive furnace as claimed in claim 1 wherein said crucible has a base comprising means for displacing said base along a longitudinal axis of said crucible.

43. An inductive furnace comprising:

a crucible adapted to receive metallic stock and to hold molten metallic stock at a predetermined temperature and within a predetermined range of hydrostatic pressures, said crucible having an axis whereby the hydrostatic pressures in said molten metallic stock vary; and a coil surrounding said crucible and adapted for connection to an AC power supply, said coil having a winding density which varies along said axis so that said coil generates an inductive heating field having an inductive power density which varies with said hydrostatic pressures in said molten metallic stock along said axis, said inductive heating field interacting with said metallic stock in said crucible.

44. An inductive furnace comprising:

a crucible adapted to receive metallic stock and to hold molten metallic stock at a predetermined temperature and within a predetermined range of hydrostatic pressures, said crucible having an axis whereby the hydrostatic pressures in said molten metallic stock vary;

a plurality of coils disposed in sequence around said crucible along said axis;

means for supplying each of said coils with power of respectively different magnitudes so that each coil generates an inductive heating field having a respectively different inductive power density corresponding to said hydrostatic pressures in said molten metallic stock, said inductive heating fields each interacting with said metallic stock in said crucible.

45. A method for temperature maintenance of a melt comprising the steps of:

containing metallic stock in a crucible, said crucible having an axis and said metallic stock, when melted, exhibiting hydrostatic pressures which vary along said axis; and inductively heating said metallic stock in said crucible by generating an inductive heating field having an inductive power density which varies along said axis so that the radiation pressures of said inductive heating field substantially counteracts said hydrostatic pressures.

46. A method as claimed in claim 45 comprising the additional step of:

displacing a base of said crucible during the step of inductively heating said metallic stock so that an upper surface of said metallic stock in said crucible is maintained at a substantially constant height.

47. A method as claimed in claim 45 wherein the step of inductively heating said metallic stock is further defined by generating an alternating inductive heating field at a frequency and gradually reducing said frequency to generate said radiation pressure which substantially counteracts said hydrostatic pressure.

48. A method for treating a melt during solidification comprising the steps of:

containing said melt in a crucible;

generating an alternating inductive heating field which interacts with said melt in said crucible, said alternating inductive heating field having a power density; and reducing said power density of said alternating inductive heating field to constantly temperature of said melt by electromagnetic forces during cooling of said melt until said melt reaches a temperature just below the solidification temperature of the melt; and permitting solidification of said melt to occur only when said temperature of said melt reaches said temperature just below said solidification temperature.

49. A method for treating a melt during solidification comprising the steps of:

containing said melt in a crucible at a predetermined temperature and within a predetermined range of hydrostatic pressures, said melt in said crucible having an axis whereby the hydrostatic pressures in said molten metal stock vary;

generating an inductive heating field which interacts with said melt in said crucible, said inductive heating field having an inductive power density; and gradually decreasing said inductive power density of said inductive heating field along said axis so that said melt solidifies at a substantially constant solidification rate from a lowest point on said axis to a highest point on said axis.

50. A method as claimed in claim 49 wherein the step of generating an inductive heating field is further defined by generating an inductive heating field consisting of a plurality of component inductive heating fields, each component inductive heating field being generated by a separate coil surrounding a portion of said crucible in a sequence along said axis, and wherein the step of gradually reducing the inductive power density of said inductive heating field is further defined by successively substantially reducing the inductive power density of each of said component inductive heating fields along said axis.

51. An inductive furnace comprising the following:

a metallic crucible adapted to receive and hold metallic stock at a predetermined temperature and within a predetermined range of hydrostatic pressures, said crucible including an outer wall that is vertically segmented adjacent an area where said metallic stock is to be held;

means for cooling said outer wall to a temperature below said predetermined temperature; and inductive coil means surrounding said crucible in a predetermined configuration for generating an inductive heating field having an inductive power density that varies dependent upon said hydrostatic pressures of said metallic stock along an axis parallel to a coordinate of a force exerted by the earth's gravitational field and acting upon said crucible.

52. An inductive furnace comprising the following:

a metallic crucible adapted to receive and hold molten metallic stock at a predetermined temperature and within a predetermined range of hydrostatic pressures, said crucible including an outer wall that is vertically segmented adjacent an area where said metallic stock is to be held;

means for cooling said outer wall to a temperature below said predetermined temperature; and inductive coil means surrounding said crucible in a predetermined configuration for generating an inductive heating field having an inductive power density that varies dependent upon properties of the metallic stock.

53. An inductive furnace comprising the following:

a metallic crucible adapted to receive and hold molten metallic stock at a predetermined temperature and within a predetermined range of hydrostatic pressures, said crucible including an outer wall that is vertically segmented adjacent an area where said metallic stock is to be held such that said metallic stock is in contact with at least a portion of said segmented area;

means for cooling said outer wall to a temperature below said predetermined temperature; and inductive coil means surrounding said crucible in a predetermined configuration for generating an inductive heating field having an inductive power density that varies dependent upon said hydrostatic pressures of said metallic stock.

54. An inductive furnace comprising the following:

a metallic crucible adapted to receive and hold molten metallic stock at a predetermined temperature and within a predetermined range of hydrostatic pressures, said crucible including an outer wall having vertically arranged segments, and a floor at a lower end of said outer wall;

a plurality of vertical slots defined between said segments, said vertical slots having a first width at a top portion thereof and a second width at a bottom portion thereof adjacent said floor, said first width being less than said second width;

electrically non-conductive material separating said segments of said crucible from one another, means for cooling said outer wall to a temperature below said predetermined temperature;

a plurality of slots formed in said floor; and inductive coil means surrounding said crucible in a predetermined configuration for generating an inductive heating field having an inductive power density that varies dependent upon said hydrostatic pressures of said metallic stock within said crucible.

* * * * *